United States Patent [19]

Powell

[11] 4,021,872

[45] May 10, 1977

[54] MATERNITY MATTRESS

[76] Inventor: Lee V. Powell, 4534 White Pine, Memphis, Tenn. 38109

[22] Filed: Oct. 6, 1975

[21] Appl. No.: 620,029

[52] U.S. Cl. ..... 5/338; 5/91
[51] Int. Cl.[2] ..... A47G 9/00
[58] Field of Search ..... 5/90, 91, 334, 337, 5/338, 345, 355, 357, 354

[56] References Cited

UNITED STATES PATENTS

| | | | |
|---|---|---|---|
| 1,107,683 | 8/1914 | Malarkey | 5/90 |
| 2,085,296 | 6/1937 | Carey | 5/91 |
| 2,254,603 | 9/1941 | Follis | 5/338 |
| 2,654,898 | 10/1953 | Eckart et al. | 5/91 |
| 2,692,396 | 10/1954 | Cheesman | 5/334 R |
| 3,118,152 | 1/1964 | Talley, Jr. | 5/91 X |
| 3,276,046 | 10/1966 | Capelli | 5/338 |
| 3,378,862 | 4/1968 | Skinner | 5/338 X |
| 3,526,911 | 9/1970 | Meyer et al. | 5/357 X |

*Primary Examiner*—Roy D. Frazier
*Assistant Examiner*—Terrell P. Lewis
*Attorney, Agent, or Firm*—John R. Walker, III

[57] ABSTRACT

A maternity mattress provided with a cavity for accommodating the abdomen of a pregnant woman as she lies upon the mattress in a prone position. The mattress tick includes a removable portion which normally lies conterminously above the cavity to readily expose the cavity. A plurality of resilient disklike members are included and which jointly conform in size and shape with the cavity to normally fill the cavity but which may be removed one at a time as the pregnancy progresses to gradually increase the size of the cavity. A peculiar washable bedsheet preferably is included and which overlies the mattress. The bedsheet includes a pocket which conforms in size and shape with and is disposed conterminously with the cavity thus providing a lining therefor. Provisions are included for removably fastening the removable portion of the mattress tick in place with a protective barrier being added to protect the woman against irritable body contact with the fastening apparatus.

10 Claims, 7 Drawing Figures

MATERNITY MATTRESS

BACKGROUND OF THE INVENTION

1. Field of the Invention

This invention relates to the field of the mattresses for beds and is particularly directed towards a maternity mattress having provisions for accommodating the large abdomen of a pregnant woman.

2. Description of the Prior Art

Maternity mattresses per se are not new as evidenced by a patent to Skinner U.S. Pat. No. 3,378,862 dated Apr. 23, 1968. It should also be mentioned that applicant is aware of a patent to Talley U.S. Pat. No. 3,118,152 patented Jan. 21, 1964 for a maternity mattress pad. However, the above-mentioned patents do not suggest or disclose applicant's maternity mattress.

Certain problems or disadvantages prevail in prior maternity mattresses and/or maternity abdominal cushions or pads. A few of these problems are: structure for gradually changing the size of the cavity provided in the mattress either does not exist or is ineffective for accommodating the expanding abdomen of the pregnant woman as the months go by. Maternity abdominal cushions or pads for the most part do not offer a solution to this problem but may even be an aggravation thereto. In other words, the cushion or pad must from necessity have a cavity for accommodating the abdomen and the structure defining the cavity must either be somewhat rigid or somewhat soft and cushioning. On the one hand the rigid structure offers the advantage of maintaining the cavity but creates the problem of holding the torso of the woman upwardly in an uncomfortable position and would tend to irritate or cut the woman. On the other hand, the soft cushioning structure defining the cavity has the advantages of allowing the torso of the woman to sink downwardly to a normally comfortable position. However, in doing so it collapses or eliminates the cavity thus becoming totally ineffective. A particular problem with prior maternity mattresses is in connection with trying to use a bedsheet therewith. More specifically, these mattresses, like ordinary mattresses, are preferably covered with a tight fitting removable and washable bedsheet. The typical bedsheet stretches over the cavity provided in the mattress thus making the cavity ineffective. In other words, in order to utilize the concept of prior maternity mattresses it is almost a foregone conclusion that to do so would require the woman to sleep directly on the mattress, i.e., eliminating the advantages of the bedsheet.

SUMMARY OF THE INVENTION

The present invention is directed toward overcoming the problems and disadvantages of prior maternity mattresses. The concept of the present invention is to provide a maternity mattress having a cavity for accommodating the abdomen of a pregnant woman as she lies upon the mattress in a prone position. The mattress tick includes a removable portion which normally lies conterminously above the cavity to readily expose the cavity. A plurality of resilient disklike members are included and which jointly conform in size and shape with the cavity to normally fill the cavity but which may be removed one at a time as the pregnancy progresses thus enabling the size of the cavity to be gradually increased commensurate with the expanding abdomen of the woman. A peculiar washable bedsheet overlies the mattress and which includes a pocket conforming in size and shape and is disposed conterminously with the cavity thus providing a lining therefor. Provisions are included for removably fastening the removable portion of the mattress tick in place with a protective barrier being added to protect the woman against irritable bodily contact with the fastening apparatus.

DESCRIPTION OF THE PREFERRED EMBODIMENT

Figure 1:
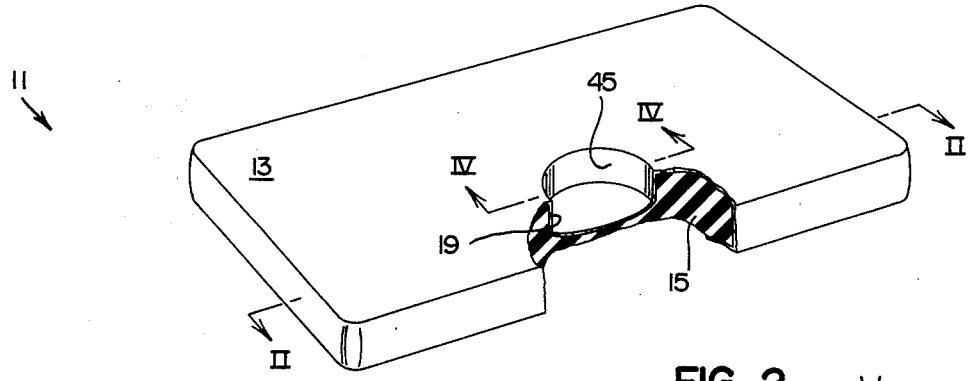
FIG. 1 is a perspective view of the maternity mattress of the present invention showing a peculiar bedsheet fitted thereon and with portions thereof cut away to more clearly depict the respective cavity and pocket provided therein.
Figure 2:
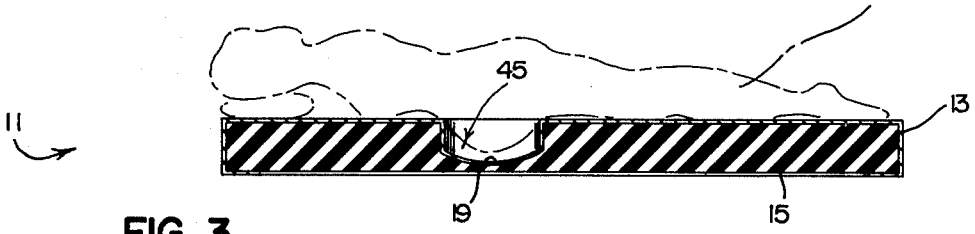
FIG. 2 is a sectional view taken as on the line II—II of FIG. 1 depicting in phantom lines a pregnant woman lying upon the mattress in a prone position with the cavity accommodating her enlarged abdomen.
Figure 3:
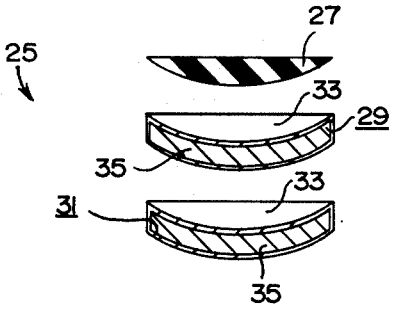
FIG. 3 is a sectional view of the structure for filling the cavity which comprises a plurality of disklike members with the view being taken as on a vertical plane through the center line of the respective disk members.

The mattress 11 of the present invention is shown in FIGS. 1 and 2 of the drawing with a removable washable bedsheet 13 overlying the mattress 11 for supporting the woman thereon. The mattress 11 includes a core body 15 preferably formed from any of the well-known foam materials and enveloped within a mattress tick 17 which is best shown in FIGS. 4 through 7 of the drawings. The core body 15 is provided with at least one circular cavity, as at 19, which has a predetermined size and vertical cross-sectional shape for accommodating the abdomen of a pregnant woman as she lies upon the mattress 11 in a prone position, the woman being characterized in FIG. 2 by the capital W. The mattress tick 17 includes a removable circular portion 21 (FIG. 7) which is normally disposed conterminously above the cavity 19 for selectively providing a circular hole 23 to readily expose the cavity 19 therethrough. Also included are resilient filler means generally characterized by the numeral 25 in FIG. 3 of the drawing for filling the cavity 19 and for gradually changing the size of the cavity 19. The filler means 25 includes a plurality of disklike members 27, 29, 31 jointly conforming in size and shape with the cavity 19 and normally being removably received therein with the disklike members 25, 27, 29 intended to be removed one at a time from the cavity 19 as the pregnancy progresses thus gradually increasing the size of the cavity 19, i.e., until it ultimately reaches the configuration as depicted in FIGS. 1 and 2 of the drawing.

At least one of the resilient disklike members, e.g., either of the disklike members 29, 31, includes a circular pillow tick envelope 33 having a multiplicity of feathers 35 contained therein to establish the resiliency thereof.

At least one of the resilient disklike members, e.g., the disklike member 27, is formed at least in part by a foam substance to establish the resiliency thereof, i.e., the disklike member may, if desired, also include a circular pillow tick, not shown, similar to the ticks 33.

The mattress 11 includes fastener means 37 for removably fastening the circular portion 21 in place for normal use of the mattress 11. More specifically, the fastener means 37 includes providing the circular portion 21 with a first zipper element 39 and providing the mattress tick 17 with a second or companion cooperative zipper element 41 as clearly shown in FIG. 7 of the drawing. Accordingly, removal of the circular portion 21 simply involves operation of the fastener means 37 or zipper elements 39, 41 in a well-known manner. Hence, the circular portion 21 is simply laid aside during the course of the pregnancy.

Figure 7:
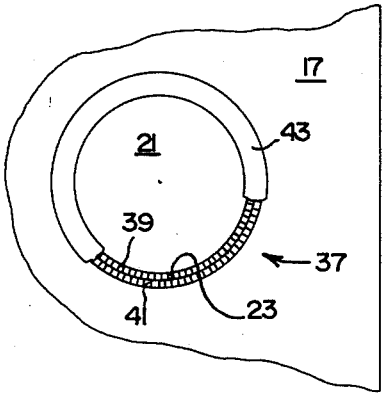
FIG. 7 is a partial plan view taken as on the line VII—VII of FIG. 6 with a portion of the flap means being removed to more clearly reveal the fastener structure which fastens the circular removable portion of the mattress tick in place.

The mattress 11 also includes flap means, as at 43, suitably attached to the mattress tick 17 in any well-known manner, e.g., as with seams, not shown, for providing a protective barrier between the fastener means 37 and the body of the woman W. From FIG. 7 of the drawing it may also clearly be seen that the flap means 43 is disposed circumjacent to the circular removable portion 21 of the mattress tick 17. Additionally, from FIGS. 4 through 6 of the drawing it may clearly be seen that the flap means 43 extends over the second zipper element 41 (when the cavity 19 is exposed) thus providing the protective barrier alluded to above. It should also be mentioned that the protective barrier is utilized, as shown in FIG. 7, i.e., for normal use of the mattress 11.

From FIGS. 1 and 2 of the drawing it may be seen that the bedsheet 13 includes a pocket 45 conforming in size and shape and being disposed conterminously with the cavity 19 for insertion therein whereby the pocket 45 provides a lining for the cavity 19.

Figure 4:
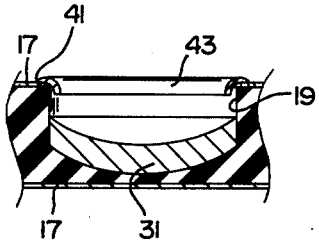
FIG. 4 is a sectional view taken as on the line IV—IV of FIG. 1 showing one of the disklike members received in the cavity.
Figure 5:
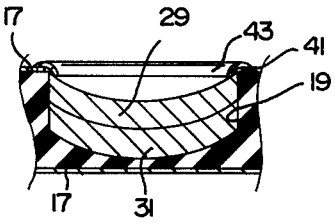
FIG. 5 is a view similar to FIG. 4 showing two of the disklike members received in the cavity.
Figure 6:
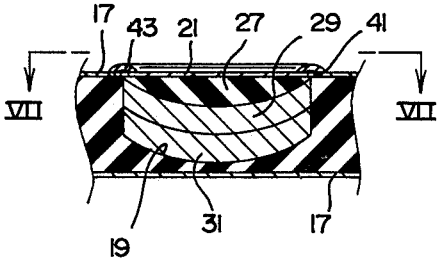
FIG. 6 is a view similar to FIG. 5 showing all of the disklike members disposed within the cavity and also showing the removable circular portion of the mattress tick being replaced to its normal position.

From the foregoing it will be seen that I am enabled to secure several advantages in connection with the maternity mattress 11. In the first place it is possible to gradually change the size of the cavity 19 as indicated in FIGS. 4 through 6 of the drawing. Further, the bedsheet 13 does not simply stretch over the cavity 19 but includes the pocket 45 for contiguous engagement with the cavity 19 thus the cavity 19 accommodates the abdomen of the woman W. Further, the circular removable portion 21 and the fastener means 37 enable the mattress 11 to be returned to a normal configuration thus the mattress 11 may optionally be used in the conventional manner. It should be understood that the cavity 19 is conveniently located to accommodate an average size woman.

Although the invention has been described and illustrated with respect to a preferred embodiment thereof, it is to be understood that it is not to be so limited since changes and modifications may be made therein which are within the full intended scope of the invention.

I claim:

1. A maternity mattress comprising a core body enveloped within a mattress tick, said core body being provided with at least one circular cavity having a predetermined size and vertical cross-sectional shape for accommodating the abdomen of a pregnant woman as she lies upon the mattress in a prone position, said mattress tick including a removable circular portion normally being disposed conterminously above said cavity for selectively providing a circular hole to readily expose said cavity therethrough, and resilient filling means for filling said cavity and for gradually changing the size of said cavity, said filling means including a plurality of disklike members jointly conforming in size and shape with said cavity and normally being removably received therein with said disklike members intended to be removed one at a time from said cavity as the pregnancy progresses thus gradually increasing the size of said cavity.

2. The maternity mattress as set forth in claim 1 in which at least one of said resilient disklike members includes a circular pillow tick envelope having a multiplicity of feathers contained therein to establish the resiliency thereof.

3. The maternity mattress as set forth in claim 1 in which at least one of said resilient disklike members is formed at least in part by a foam substance to establish the resiliency thereof.

4. The mattress as set forth in claim 1 in which is included fastener means for removably fastening said circular portion of said mattress tick in place for normal use of said mattress.

5. The mattress as set forth in claim 4 in which is included flap means attached to said mattress tick for providing a protective barrier between said fastener means and the body of the woman, said flap means being disposed circumjacent to said removable portion.

6. In combination, a maternity mattress comprising a core body enveloped within a mattress tick, said core body being provided with at least one circular cavity having a predetermined size and vertical cross-sectional shape for accommodating the abdomen of a pregnant woman as she lies upon the mattress in a prone position, said mattress tick including a removable circular portion normally being disposed conterminously above said cavity for selectively providing a circular hole to readily expose said cavity therethrough, and resilient filling means for filling said cavity and for gradually changing the size of said cavity, said filling means including a plurality of disklike members jointly conforming in size and shape with said cavity and normally being removably received therein with said disklike members intended to be removed one at a time from said cavity as the pregnancy progresses thus gradually increasing the size of said cavity; and a removable washable bedsheet overlying said mattress for supporting the woman thereon, said bedsheet including a pocket conforming in size and shape and being disposed conterminously with said cavity for insertion therein whereby said pocket provides a lining for said cavity.

7. The combination as set forth in claim 6 in which at least one of said resilient disklike members includes a circular pillow tick envelope having a multiplicity of feathers contained therein to establish the resiliency thereof.

8. The combination as set forth in claim 6 in which at least one of said resilient disklike members is formed at least in part by a foam substance to establish the resiliency thereof.

9. The combination as set forth in claim 6 in which is included fastener means for removably fastening said circular portion of said mattress tick in place for normal use of said mattress.

10. The combination as set forth in claim 9 in which is included flap means attached to said mattress tick for providing a protective barrier between said fastener means and the body of the woman, said flap means being disposed circumjacent to said removable portion.

* * * * *